US012492875B2

(12) United States Patent
Wutte et al.

(10) Patent No.: US 12,492,875 B2
(45) Date of Patent: Dec. 9, 2025

(54) RIFLES COMPRISING A BOLT CATCH DEVICE

(71) Applicant: GLOCK TECHNOLOGY GMBH, Ferlach (AT)

(72) Inventors: Andreas Wutte, Ferlach (AT); Elmar Bilgeri, Klagenfurt (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 4 days.

(21) Appl. No.: 18/718,047

(22) PCT Filed: Nov. 25, 2022

(86) PCT No.: PCT/EP2022/083278
§ 371 (c)(1),
(2) Date: Jun. 9, 2024

(87) PCT Pub. No.: WO2023/104548
PCT Pub. Date: Jun. 15, 2023

(65) Prior Publication Data

US 2025/0052530 A1 Feb. 13, 2025

(30) Foreign Application Priority Data

Dec. 10, 2021 (EP) ..... 21213660

(51) Int. Cl.
*F41A 17/36* (2006.01)
*F41A 35/06* (2006.01)

(52) U.S. Cl.
CPC ..... *F41A 17/36* (2013.01); *F41A 35/06* (2013.01)

(58) Field of Classification Search
CPC ..... F41A 17/34; F41A 17/36; F41A 17/40; F41A 17/42; F41A 3/68; F41A 35/06
See application file for complete search history.

(56) References Cited

U.S. PATENT DOCUMENTS 2,389,631 A * 11/1945 Moore ..... F41A 3/32 89/142
5,608,981 A * 3/1997 Canaday ..... F41A 15/16 42/25
7,219,462 B2 5/2007 Finn
(Continued)

FOREIGN PATENT DOCUMENTS

EP 985896 B1 3/2000
EP 1692451 B1 8/2006
(Continued)

*Primary Examiner* — Jonathan C Weber
(74) *Attorney, Agent, or Firm* — Raven Patents, LLC; Anton E. Skaugset

(57) ABSTRACT

Firearms including a bolt catch device, having a receiver comprising a duct, wherein the bolt catch device comprises a foot, a slider, and a spring, and the foot, on the leg thereof and on the magazine well side, has a groove for receiving the spring and, on the side facing the trigger device, has a socket; wherein the slider has, on the lower portion thereof, bearing bolts for being inserted into and pivoted in the socket, wherein the slider has, at the upper end thereof, a protrusion which protrudes in the direction of the magazine well beyond the contour of the duct, and wherein the receiver has an abutment that protrudes into the groove in order to prestress the spring of the bolt catch into the rest position.

10 Claims, 4 Drawing Sheets

(56) References Cited

U.S. PATENT DOCUMENTS

| | | | | |
|---|---|---|---|---|
| 8,015,742 | B2 | 9/2011 | Zedrosser | |
| 9,091,499 | B2 * | 7/2015 | Overstreet | F41A 9/70 |
| 9,651,328 | B1 * | 5/2017 | Oglesby | F41A 35/06 |
| 2013/0014416 | A1 * | 1/2013 | Sisgold | F41A 9/66 42/17 |
| 2017/0160026 | A1 * | 6/2017 | Walther | F41A 35/06 |

FOREIGN PATENT DOCUMENTS

| | | | |
|---|---|---|---|
| PL | 224544 | B1 | 1/2017 |
| WO | 2021121708 | A1 | 6/2021 |
| WO | 2021121709 | A1 | 6/2021 |
| WO | 2021121710 | A1 | 6/2021 |

* cited by examiner

RIFLES COMPRISING A BOLT CATCH DEVICE

TECHNICAL FIELD

The present disclosure relates to firearms, and in particular to a semi- and/or fully automatic firearms comprising a bolt catch device, usually referred to below as a bolt catch.

BACKGROUND

When present, bolt catches are generally moved from a rest position, in which the bolt is released, to a working position, in which the bolt catch locks the bolt of the firearm in an open position, by engagement with the follower of an ammunition magazine, in order to speed up and facilitate magazine changes.

The bolt catch disclosed in the aforementioned document, U.S. Pat. No. 7,219,462 B2, interacts with the magazine holder. The latter can be moved on both sides in the release direction. The bolt catch device, which is activated by the magazine follower after the last cartridge has been fired against the force of a spring and catches the bolt in the rearmost or near the rearmost position, can also be released from both the left and right after the user has inserted a new, loaded magazine. The bolt catch device itself consists of a pin which is arranged in the firearm center plane and extends approximately vertically when the firearm is held in a normal, substantially horizontal manner. Bearing is dependent on the magazine catch device. All that is said about the spring that forces this bolt catch device into the open position is that it can be provided. Mounting and dismounting are not easy to accomplish due to the fusion with the magazine holder.

In principle, bolt catch devices have existed for a long time and in a wide variety of designs, which also depend on the structure and nature of the firearm and the magazine used, and thus its follower. The follower is the part of the magazine that moves upward in relation to the magazine body under the force of a spring and thus feeds the cartridges loaded in the magazine above it to the firearm. This follower has an actuator at a suitable point, be it a projection, an edge, or the like, which, when it is upwardly limited in further upward movement after the last cartridge has been inserted into the firearm through a projection at the top edge of the magazine, pushes the bolt catch device upward against the force of its spring, and thus into the movement path of the bolt, i.e. the active position, so that the bolt remains fixed in the open position.

The requirements of such a bolt catch are robustness and reliability. It should consist of as few parts as possible and of parts that are easy to assemble. It should take up little space, its components should be robust and easy to handle, and it should be operable from both sides.

If the described bolt catch device is examined more closely in this respect, it is possible to see that it can be operated from both sides, but that it is problematic in terms of bearing in the firearm and of assembly and dismounting.

Other bolt catch devices are known, for example, from U.S. Pat. No. 8,015,742 B2 (corresponding to EP 2 045 562 B1), in which, due to the complete combination of bolt catch and magazine holder, the requirements of simplicity and easy mounting and dismounting are not met, and to an even greater degree than in the publication first mentioned.

EP 985 896 B1 discloses a bolt catch device which has a prestressing spring that extends into the trigger guard, and is therefore neither simple in terms of its construction nor simple in terms of its mounting and dismounting.

An even more complex device, referred to as a bolt lock, is known from EP 1 692 451 B1, in which various elements can be rotated about axes of rotation, which requires bearings, making the device even more complex.

The same applies to a bolt catch device as is known from PL 224 544 B1, which also uses a lever mounted in a special bearing. Such levers are used in numerous other variants.

The content of the cited publications: U.S. Pat. Nos. 7,219,462 B2, 8,015,742 B2, EP 985 896 B1, EP 1 692 451 B1, PL 224 544 B1, and the content of WO2021/121708 A1, WO2021/121710 A1, and WO2021/121709 A1, which are mentioned below, is hereby incorporated by reference to the content of the present application for jurisdictions in which this is possible.

There is therefore a need for a bolt catch device that does not have the aforementioned disadvantages and which is particularly simple in its construction, consists of few components, can be assembled and disassembled easily and reliably, and is robust and durable. In particular, it should also be possible, at least in one embodiment, to assemble or disassemble it without tools.

SUMMARY

The disadvantages and drawbacks of previous bolt catch devices are overcome by the bolt catch devices of the present disclosure, which exhibit reduced complexity and enhanced reliability.

In some examples, the firearms of the present disclosure have a receiver comprising a duct, where the duct is configured to receive a bolt catch device having a foot, a slider, and a spring, and the foot, on the leg thereof and on the magazine well side, has a groove for receiving the spring and, on the side facing the trigger device, has a socket; where the slider has, on the lower portion thereof, bearing bolts for being inserted into and pivoted in the socket, where the slider has, at the upper end thereof, a protrusion which protrudes in the direction of the magazine well beyond the contour of the duct, and wherein the receiver has an abutment that protrudes into the groove in order to prestress the spring of the bolt catch into the rest position.

Figure 1A:
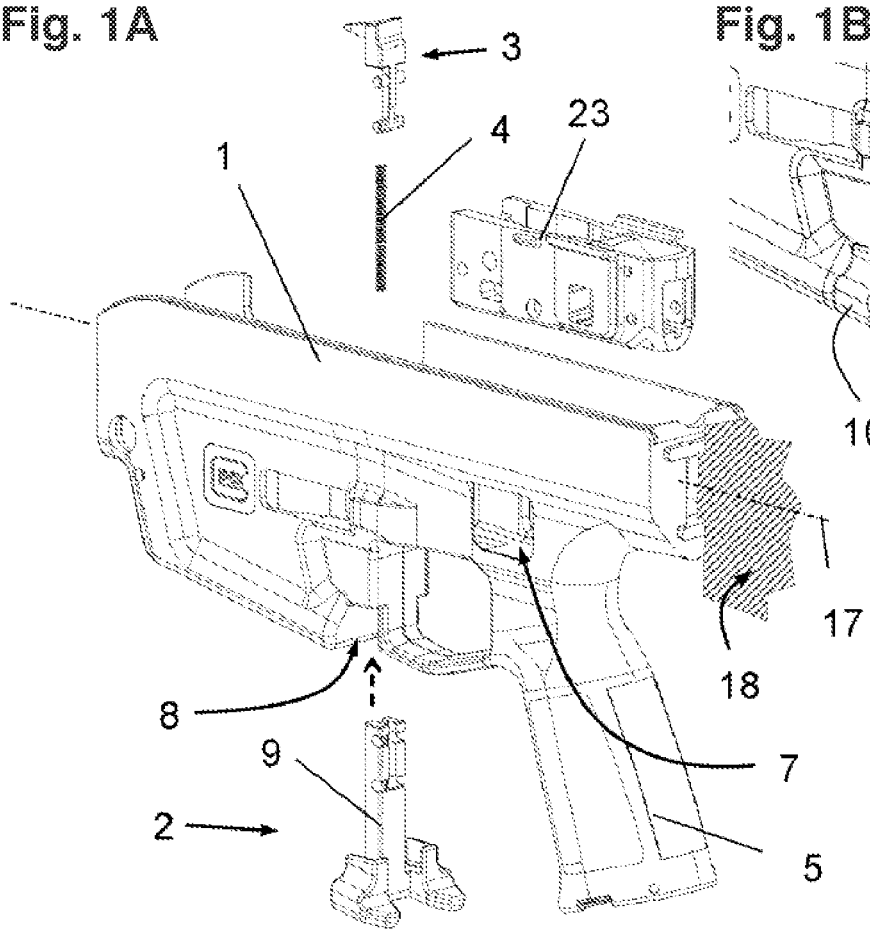
FIGS. 1A and 1B are a perspective exploded view and a detail, respectively, of a firearm receiver with the three components of the bolt catch device according to the present disclosure.

7B shows several different views of an alternative exemplary foot according to the present disclosure.

DETAILED DESCRIPTION

In general terms, the bolt catch of the present disclosure can be mounted substantially vertically between the magazine well and the trigger device of a firearm when the firearm is held in a horizontal position. It should be pointed out here that, as in many firearms, that from the perspective of the shooter the trigger device is formed before the magazine well. The firearms of the present disclosure will be explained using an example of this type of firearm.

In other words: The bolt catch executes a pure up and down movement in the receiver of the firearm, and, if present, in its lower receiver (also called lower), by which it is also guided. It preferably consists of only three parts.

In a firearm which has a vertical firearm center plane, also known as the plane of symmetry, and a horizontal barrel axis, and which is in the assembled state and held normally, the following can be carried out: The practical implementation of this concept provides for a foot having an elongated leg, preferably made of plastic, as a first part. Although in principle a one-sided variant is also conceivable, the following description covers a preferred embodiment according to which this first part is designed symmetrically to a plane of symmetry in order to enable usability from both sides. When assembled and with the firearm held normally, the plane of symmetry coincides with that of the firearm, or also with that of the firearm center plane, or is at least parallel thereto. The leg then extends vertically and is inserted into the firearm from below. At the lower end, the foot protrudes beyond the leg and the edge of the duct on both sides and forms an end limit when inserted into the receiver of the firearm. The leg has at mid-height, normal to the plane of symmetry, and over at least part of its entire width, a groove-like socket formed in its posterior wall. From the socket up to the upper end, the leg has a vertically extending longitudinal slot on its rear side, which is designed in the shape of a furrow.

On its front side, which faces the magazine or the magazine well in the assembled state, the leg has a vertically extending groove which starts at the upper edge and the lower end of which ends within the leg. Preferably, the groove, which can also be a T-shaped undercut or similarly designed depression, ends at a distance from the lower edge of the foot, but below the socket.

A helical spring, which preferably does not protrude beyond the lateral sides of the groove, is inserted into this groove as the second part of the device. In principle, other types of springs, such as leg springs, leaf springs, or the like, can also be provided in order to bias the bolt catch downward.

In a preferred embodiment, another furrow-like retaining socket, referred to below as a stop, is provided parallel to the socket and above it.

The third part of the device according to the present disclosure, preferably made of metal, and called the slider, is substantially hook-shaped, forming a shank and a head. The lower end of the shank has bearing bolts which protrude normal to the plane of symmetry, which are preferably flattened on their circumference, and which can be pushed into the groove-like socket of the leg in a corresponding angular position. When the slider is then pivoted into the use position, in which removal from the socket is not possible, the shank extends substantially parallel to the longitudinal extension of the leg and lies between the two sides of the longitudinal slot. The head of the slider protrudes beyond the upper end face of the leg. The head forms the second part of the "hook," and has a projection, referred to below as the protrusion, which extends approximately normal to the leg and which protrudes forward, approximately parallel to the barrel axis and toward the magazine, beyond the front wall of the leg into the magazine well in order to be able to interact with the follower of the magazine. The head can also be referred to as the bolt catch portion, since it moves from the rest position to the working position, and thus into the movement path of the bolt of the firearm, as a result of the longitudinal movement of the bolt catch, as a result of which the bolt is caught.

In a preferred embodiment, the shank has, between the bearing bolt and the head, retaining bolts which are designed similarly to the bearing bolts and which, when the slider is rotated about the axis of rotation of the socket, enter and are held elastically by the retaining socket by means of elastic deformation of said retaining socket, thereby reducing the risk of undesired rotation and separation outside the guide in the firearm.

With regard to the following description, the disclosed bolt catch device can also be used with minor adjustments for firearms in which, starting from the shooter, a magazine well is provided before the grip part and/or the trigger device in the direction of the barrel, as is the case with "bullpup" rifles. It is also the case in firearms of this kind that the vertical bolt catch can interact with a bolt, the bolt carrier, or correspondingly designed translation elements in order to be deflected upward into the working position by the empty magazine, and only brought back into the rest position via actuation by the shooter.

The bolt catch device of the present disclosure is explained in more detail below with reference to the drawings and to an exemplary embodiment.

FIG. 1 is a perspective view of a firearm receiver 1 (a specifically provided lower is hereinafter only referred to if it is relevant to the disclosure). As shown, the grip 5 can be part of the firearm receiver 1 or of the lower, or, depending on the design of the firearm, it can also be a separate component. No trigger is shown in the trigger guard 6, since it is part of a trigger mechanism (not shown), which is preferably received in a trigger housing 23 shown above the firearm receiver 1 and, as can be seen from the embodiment shown, is elastically held in retaining recesses 7 (FIG. 2). Examples of the design of such a trigger housing and examples of a trigger mechanism are known from WO2021121708A1, WO2021121710A1, and WO2021121709A1.

The leg 9 of the foot 2, which can also be referred to as the "base," is pushed from below into a duct 8 serving as a guide, as indicated by the movement arrow. The width of the lower end of the foot with handles 10 which abut parts of the firearm or its receiver creates a limit beyond which the foot 2 cannot be pushed into the duct 8. The handles 10 attached to the left and right at the lower edge of the foot 2 protrude beyond the receiver 1 so that they remain accessible and usable even after assembly.

When assembled, the spring 4 lies in the groove 11 (see FIG. 5B) and is prevented from falling out by the lower end of the groove. Due to the joint assembly with the foot or base 2, it upwardly abuts an abutment 12 (FIG. 2A) which is provided on the firearm or its receiver 1. This largely eliminates the risk of loss. Toward the end of the insertion of the foot 2, the spring 4 is compressed and thus prestressed and consequently pushes the foot 2 downward. The cross-section of the groove 11 can be U-shaped or slightly undercut, thereby forming a channel that is partially open toward the front. In the latter case, the spring 4 can only be inserted into the groove 11 from above, which reduces the risk of it being lost, bent, or even damaged during insertion. If the groove 11 has an undercut cross-section, it is advantageous for the spring 4 to be a helical spring of which the outer diameter is larger than the narrow point of the undercut, which is only designed to interact with the abutment 12 toward the front.

Figure 3A:
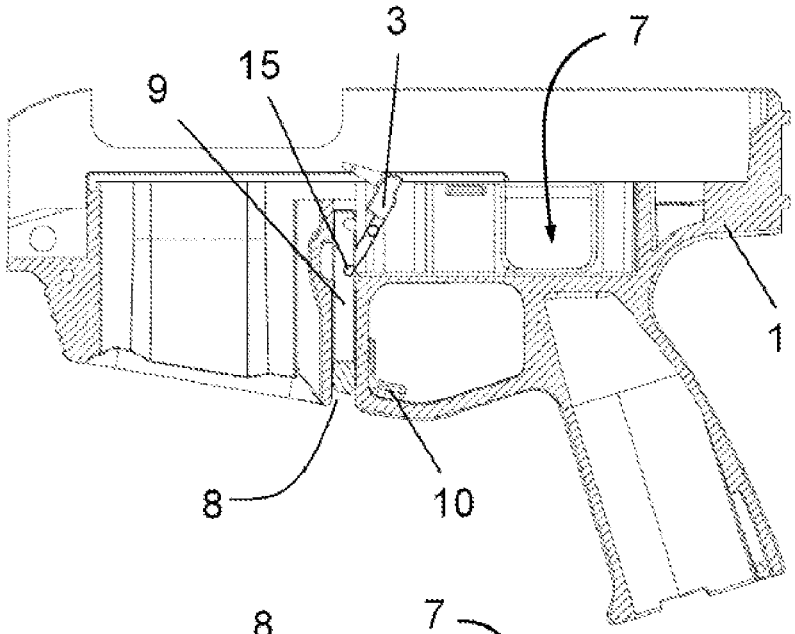
FIGS. 3A and 3B are views analogous to FIGS. 2A and 2B, with a partially pivoted slider.
Figure 3B:
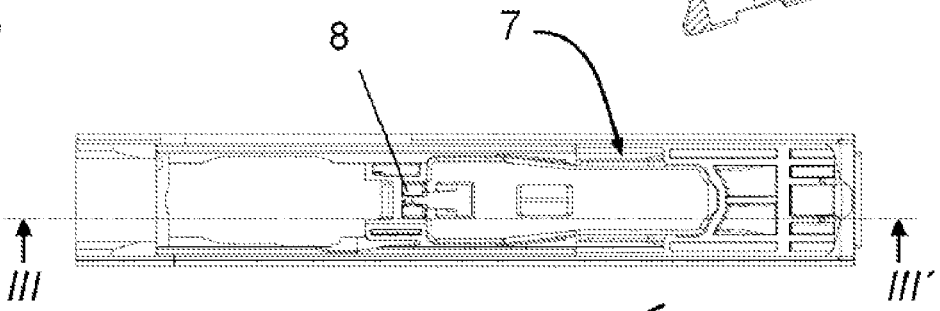

The slider 3 is shown in FIG. 1A above the receiver 1, and can only be inserted and mounted from there, which will be explained with reference to FIGS. 3A and 3B, FIG. 3A being a section III-III' of FIG. 3B: When the user compresses the spring 4 during mounting (this permanently limits the upward movement of the base 2 or leg 9), the groove-like socket 13 comes into a region of the duct 8 in the receiver 1 of the firearm, where it no longer has a rear wall on the side of the socket 13, and the socket 13 is exposed. In this (dis)mounting position, the third part of the bolt catch, the slider 3, can be inserted from above into the receiver in a pivoted position, as shown in FIG. 3A, and moved forward into the socket 13 in the direction of the barrel axis 17.

After the bearing bolts 15 have been introduced into the socket 13, the slider 3 can easily be pivoted into the working position.

In a preferred embodiment, the rear side of the slider 3 has a conical shape in the lower region in order to facilitate insertion into the duct 8 after the bearing bolt 15 has been inserted into the socket 13. The force of the spring 4 thus pulls the slider 3 into the rest position.

Figure 5A:
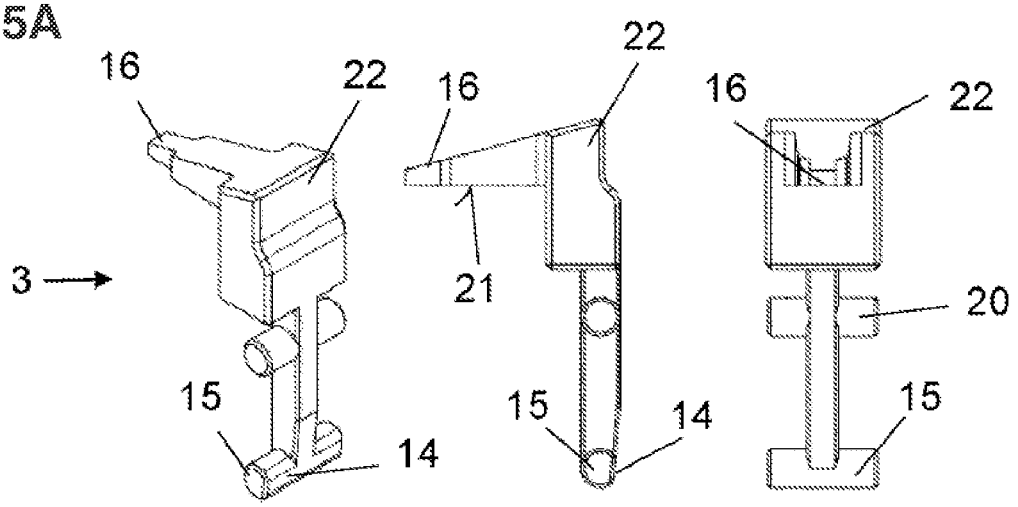
FIG. 5A shows several different views of an exemplary slider according to the present disclosure.
Figure 6A:
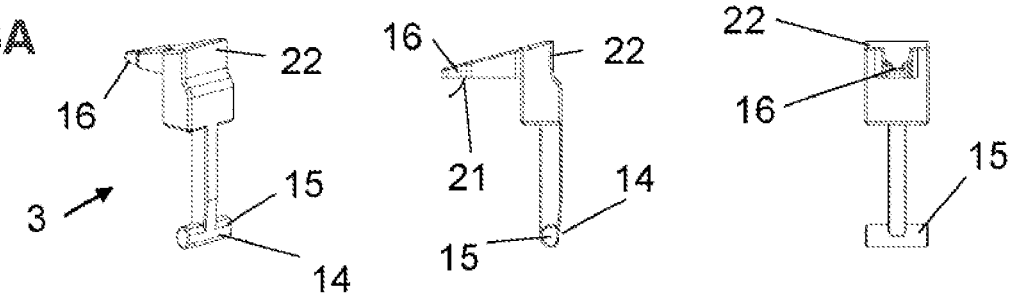
FIG. 6A shows several different views of an alternative exemplary slider according to the present disclosure.
Figure 7A:
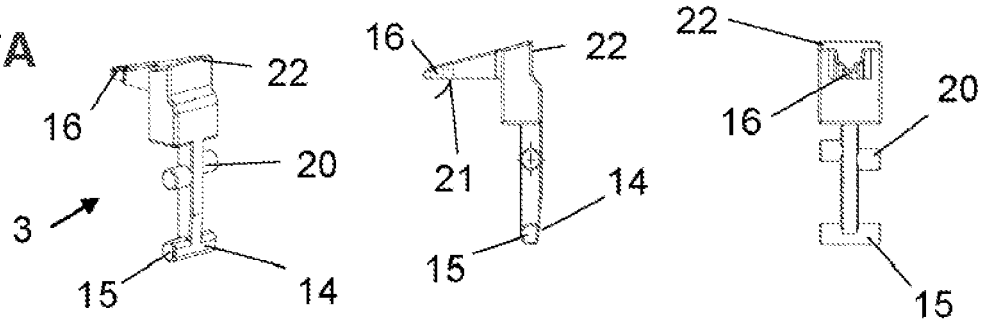
FIG. 7A shows several different views of an alternative exemplary slider according to the present disclosure; FIG.

In a particularly preferred embodiment, the bearing bolts 15 have a flattening 14, which can be seen particularly well in FIGS. 5A, 6A, and 7A. This flattening of the circular cross-section of the bearing bolt 15, also in combination with the previously described downwardly tapering, conical shape of the lower portion of the slider 3 in the region of the bearing bolt 15, can facilitate the insertion of the bearing bolt 15 into the socket 13, as can be seen when viewed together with FIG. 3A.

Figure 2A:
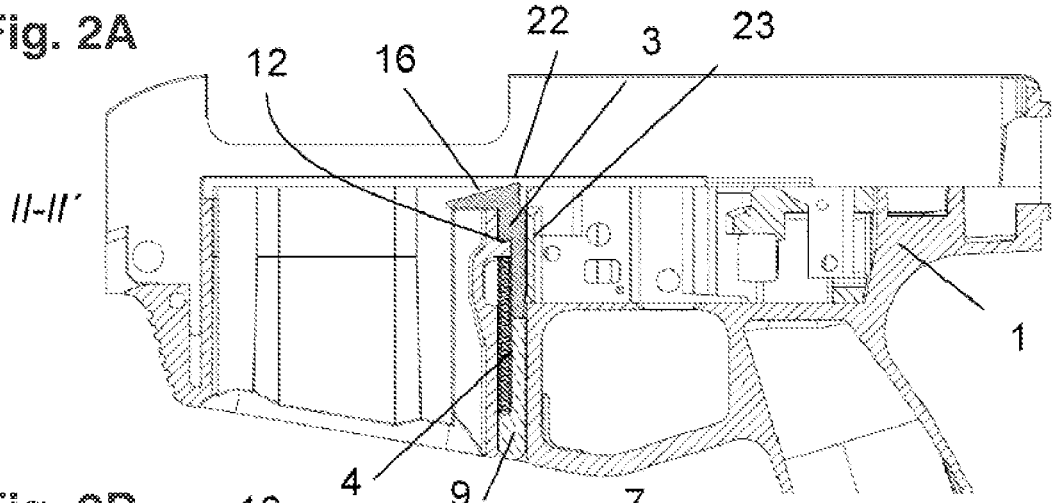
FIGS. 2A and 2B are a section view of the firearm receiver along the firearm center plane, and a plan view of the firearm receiver, respectively.
Figure 2B:
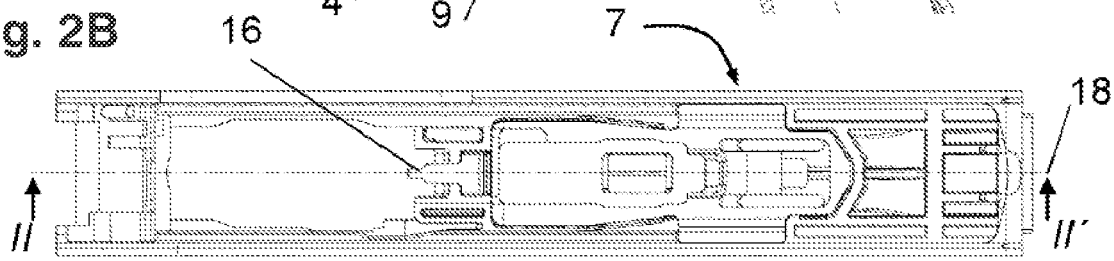

FIG. 2A indicates a section II-II' through the firearm center plane 18, which corresponds, at least cum grano salis, to the plane of symmetry of the firearm and is indicated in FIG. 2B. When the user lets go of the foot 2, the spring 4 presses it downward a little until the underside of the protrusion 16 of the slider 3, clearly visible as contact surface 21 in FIGS. 5A, 6A, and 7A, abuts the edge of the duct 8 or another part of the receiver 1 intended for this purpose. Alternatively, a separate support element can also be inserted or mounted on the rear of the receiver 1 in order to enable vertical guidance and support of the assembled bolt catch to the rear. Since, at this height, the socket 13 is somewhat lower than the recess on the rear wall of the duct 8, a certain degree of security against loss is already provided in this variant.

There are several ways to keep the slider 3 in the correct angular position with respect to the foot 2:

A very simple possibility with today's modular firearms, which is shown in the drawing, is for the mounting or dismounting of the entire bolt catch device to only be able to take place if a trigger housing 23, in which the entire trigger device is located, and which is arranged in the firearm behind the magazine and above the trigger guard 6 in the receiver 1, has first been removed from the receiver 1 (or the lower). The trigger housing can be held in the receiver 1 by fastening means, such as screws, or, as described in particular in WO2021/121709 A1, elastically held in the lower and supported or clamped by lateral extensions of the trigger housing at the recesses 7. After inserting the bolt catch device, as described above, the duct 8, in which the bolt catch device is located, is also closed at its rear end by inserting the trigger housing 23, or alternatively another separate support element, and the slider 3 can no longer be tilted or pivoted relative to the foot 2. This relationship can be seen clearly in FIG. 2A, in which the supporting effect of the trigger housing 23 with its front side forming a kind of rear wall for the duct 8 is clearly visible. The aforementioned design of the head of the slider 3 prevents the entire bolt catch device from falling downward (out), whether under the effect of gravity or of the spring force of the spring 4.

Figure 7B:
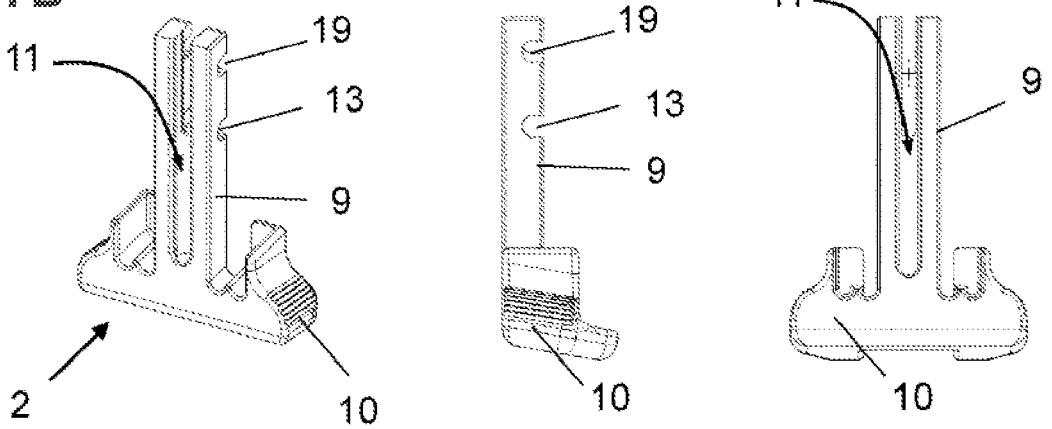

A further possibility, which can also be combined with the aforementioned possibility and is shown as an embodiment in the drawings, in particular in FIG. 7B, is for at least one further, likewise transversely extending receptacle, the so-called stop 19, to be provided in the leg 9 above the groove-like socket 13, which interacts with the stop bolt 20 of the slider 3 in such a way that it holds the preferably circular stop bolt 20 by elastic deformation of the stop 19. The cross-section of the stop 19 can therefore be slightly undercut.

In a preferred embodiment, the diameter of the stop 19 is smaller than the diameter of the bearing bolt 15, so as to reliably prevent the slider 3 from being inserted into the foot 2 in an offset and thus accidentally incorrect manner.

This development also makes it possible for the duct 8 for the bolt catch device to be open to the rear above the position of the socket 13, while the bearing and guidance of the bolt catch device in the region between the socket 13 and the handle 10 is completely sufficient.

Figure 4:
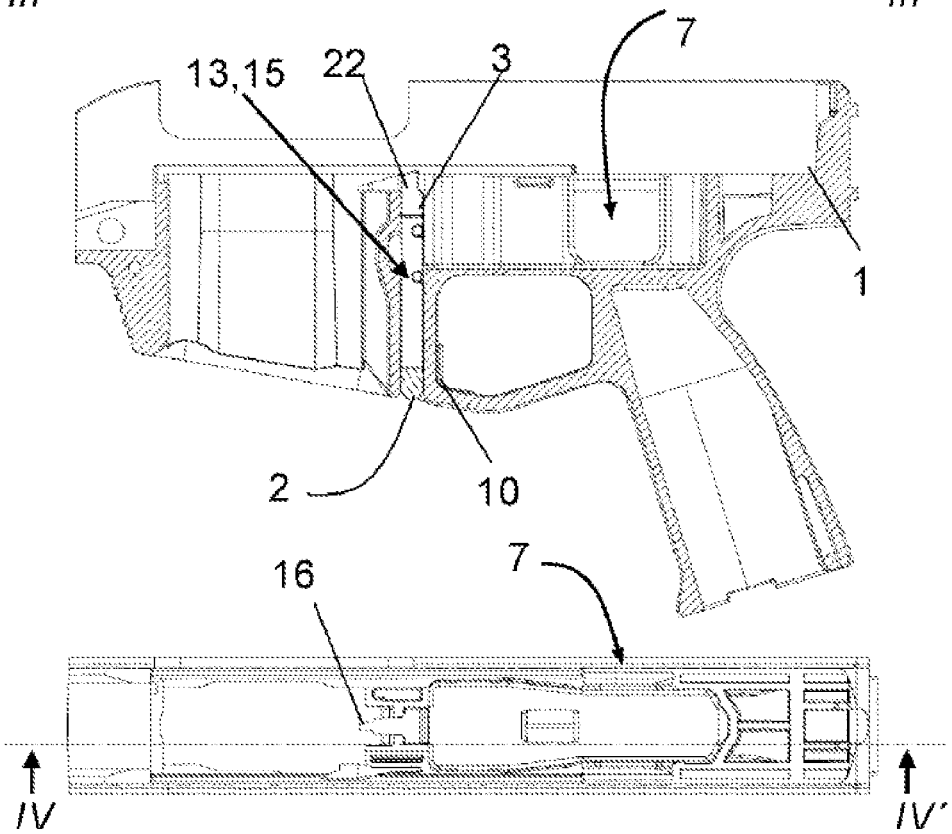
FIGS. 4A and 4B are views analogous to FIGS. 2A and 2B, with a fully mounted slider.

FIG. 4A shows the situation chronologically after the situation during mounting shown in FIG. 3 in a section IV IV' of FIG. 4B parallel to the firearm center plane: The slider 3 is in its working position with respect to the foot 2, and the spring 4 (note the section plane in FIG. 4B), which is not visible, pushes the entire device downward; the contact surface 21 of the slider 3 lies on the edge of the duct 8, or on top of the abutment 12, of the receiver 1, which prevents any further downward movement. The socket 13 is located in a region of the duct 8 in which its (real) rear wall is provided, so that tilting between the foot 2 and the slider 3 is reliably avoided. The trigger housing 23 (not shown in this figure) can now be used, as becomes clear from the combination with FIGS. 1 and 2.

FIG. 5A shows the slider 3 in perspective, from the side, and from the front. The position of the bearing bolts 15, as well as of the stop bolts 20 provided here in a preferred embodiment, can be clearly seen together with the flattening 14 and the protrusion 16. The bevel in the lower part of the slider can also be clearly seen from the middle illustration in FIG. 5A. This bevel facilitates the insertion into the duct 8 after the situation shown in FIG. 3A. The underside of the protrusion 16 forms a rest surface 21 which rests against the retaining abutment 12 of the receiver 1 in the rest state (FIGS. 2A and 2B). This rest surface 21 or the protrusion 16 comes into contact with the follower (not shown) of the magazine when the last cartridge of the magazine is inserted into the chamber, and is forced upward by the magazine spring, which is stronger than spring 4.

This movement, which is easy to imagine when also viewing FIGS. 4A and 4B, causes the bolt catch portion 22 on the rear of the protrusion 16 or of the head of the slider 3 to enter the movement path of the bolt (not shown) or of a retaining surface of a bolt carrier. The inclined design of the top of the protrusion 16 allows the bolt, if it is not already behind the bolt catch portion 22, to push the entire device downward against the force of the magazine spring and eject the last cartridge casing. During the subsequent forward movement, it stops at the bolt catch portion 22.

Figure 1B:
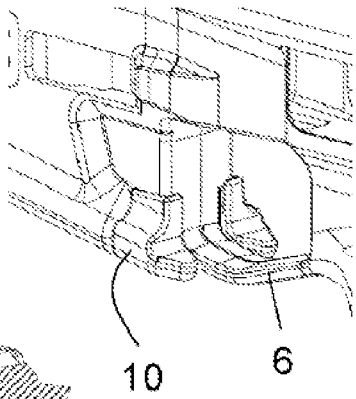
Figure 5B:
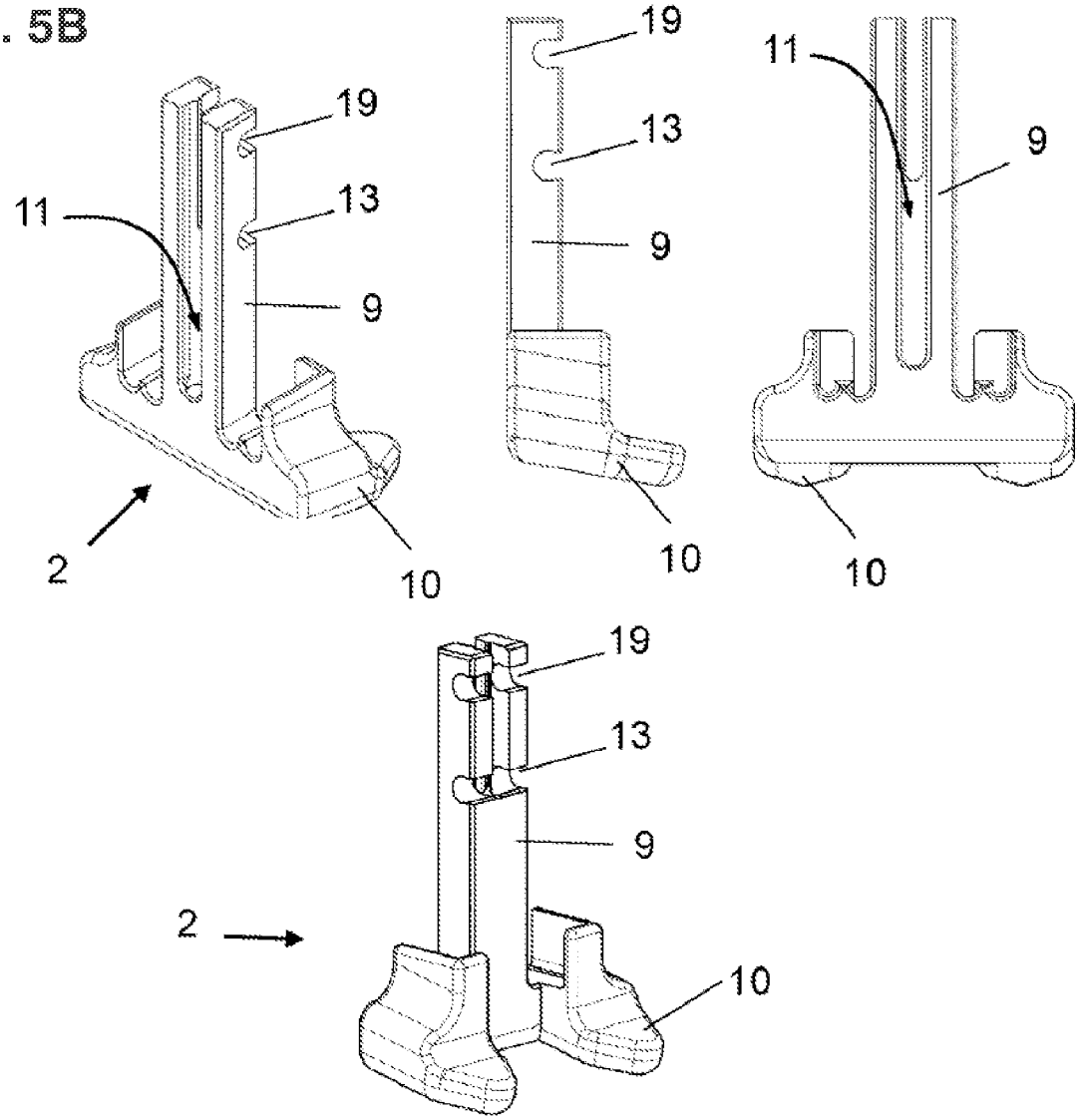
FIG. 5B shows several different views of an exemplary foot according to the present disclosure.

In the same way, FIG. 5B clearly shows the foot 2, the handle(s) 10, the socket 13, the stop 19, and the groove 11 for the spring 4. The shape and dimensions of the top of the handle 10 are preferably adapted to the shape and dimensions of the receiver 1 so that they can, as much as possible, interact in a gap-free manner, which prevents or at least makes it more difficult for foreign bodies to penetrate. The outside of the handle 10 is defined by the need to be able to use it easily and without any particular consideration; the secondary figure of FIG. 1B shows the adaptation to the trigger guard as an example.

Figure 6B:
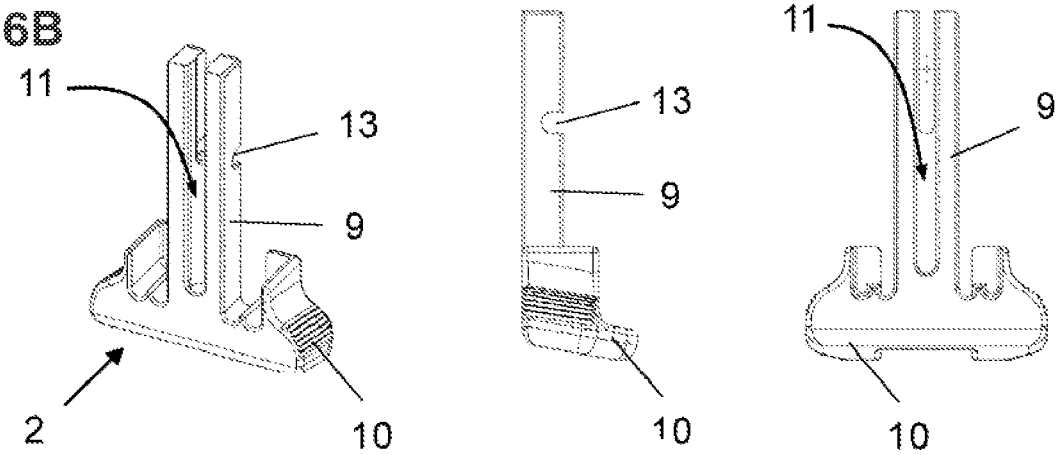
FIG. 6B shows several different views of an alternativ3e exemplary foot according to the present disclosure.

FIGS. 6A and 6B likewise show a variant without a stop 19 and without additional stop bolts 20; a more detailed explanation does not appear necessary in the light of the above statements.

FIGS. 7A and 7B show another preferred variant with stops 19 or stop bolts 20 that are vertically offset relative to one another on the leg 9. Such a design can be advantageous for mechanical reasons with regard to the strength of the foot 2, which is made of plastic. In addition, in this way, the assembly of the bolt catch device, i.e. when mounting the slider 3 in the foot 2 or leg 9, can only take place when the bearing bolts 15 are in the correct position in the sockets 13 provided for this purpose.

Similarly, although not shown separately, the optional stops 19 and their corresponding stop bolts 20 can have a smaller diameter or dimension in the longitudinal direction of the leg 9 than the pairing consisting of the bearing bolt 15 and the socket 13. This can also contribute to avoiding faulty mounting.

In the present description and the claims, the terms "front," "rear," "upward," "downward," and so on are used in the generally accepted form and with reference to the object in its usual use position. This means that, in a firearm, the muzzle of the barrel is at the "front," the bolt or slide is moved "backward" by the explosive gas, etc.

It should also be noted that in the description and the claims, terms such as the "lower region" of a suspension, reactor, filter, structure, or device, or of an object more generally, refer to the lower half and in particular the lower quarter of the overall height; "lowermost region" refers to the lowermost quarter and in particular to an even smaller part, while "central region" refers to the central third of the overall height (width–length). The same applies, mutatis mutandis, to the "front" or "rear" region. All of these terms have their generally accepted meaning applied to the intended position of the object in question.

In the description and the claims, "substantially" means a deviation of up to 10% of the stated value, if physically possible, both downward and upward, or otherwise only in the appropriate direction; in the case of degrees (angle and temperature), it means ±10°.

With designations such as "a solvent," the word "a" should not be considered to denote a number; rather, it is an indefinite article, unless the context indicates otherwise.

The term: "combination" or "combinations," unless otherwise stated, refers to all types of combinations, starting from two of the relevant components up to a plurality of or all such components; the term "containing" also means "consisting of."

The features and variants indicated in the individual embodiments and examples may be freely combined with those of the other examples and embodiments and, in particular, may be used for characterizing the invention in the claims without necessarily including the other details of the particular embodiment or of the particular example.

| List of reference signs: | |
|---|---|
| 1 | Firearm receiver |
| 2 | Foot, base |
| 3 | Slider |
| 4 | Spring |
| 5 | Grip |
| 6 | Trigger guard |
| 7 | Recesses |
| 8 | Duct |
| 9 | Leg, post |
| 10 | Handle(s) |
| 11 | Groove |
| 12 | Abutment |
| 13 | Socket |
| 14 | Flattening |
| 15 | Bearing bolt(s) |
| 16 | Protrusion |
| 17 | Barrel axis |
| 18 | Firearm center plane |
| 19 | Stop |
| 20 | Stop bolt |
| 21 | Rest surface |
| 22 | Bolt catch portion |
| 23 | Trigger housing |

The invention claimed is:

1. A firearm, including a receiver having a firearm center plane, the firearm comprising:

a magazine well defined by the receiver and configured to receive a magazine;

a trigger device disposed along the firearm center plane in front of or behind the magazine well;

a duct defined in the receiver that, when the firearm is held horizontally, extends substantially vertically between the magazine well and the trigger device; and a bolt catch device disposed in the duct, the bolt catch device having a bolt catch portion configured to interact with a bolt or a bolt carrier of the firearm when in a working position, and when in the working position the bolt catch device engages in the movement path of the bolt;

wherein the bolt catch device comprises a foot, a slider, and a spring;

the foot has a leg and at least one handle that protrudes laterally beyond a contour of the duct;

the leg of the foot defines a groove configured to receive the spring, the groove being defined on the side of the leg facing the magazine well;

the leg of the foot defines a socket, the socket being defined on the side of the leg facing the trigger device, wherein the socket has an axis that extends normal to the firearm center plane;

the slider includes, on a lower portion thereof when assembled, bearing bolts that are configured to be inserted into and pivoted in the socket;

the slider includes, at an upper end thereof, a protrusion that protrudes in a direction of the magazine well beyond the contour of the duct; and the receiver includes an abutment that protrudes into the groove so as to prestress the spring of the bolt catch into a rest position.

2. The firearm of claim 1 wherein the trigger device can be upwardly removed from the receiver.

3. The firearm of claim 1, wherein the slider has a downwardly tapering, conical shape on a rear side of the slider.

4. The firearm of claim 1, wherein the bearing bolts of the slider have a circular cross-section, and the circular cross-section has a flattened portion.

5. The firearm of claim 1, wherein the leg of the foot has at least one stop in the form of an undercut recess that extends normal to the firearm center plane; and the slider has at least one stop bolt having a complementary shape that comes into clamping engagement with the at least one stop by means of elastic deformation when the bearing bolts pivot in the socket.

6. The firearm of claim 5, wherein the at least one stop and the at least one stop bolt have a larger diameter than the sockets and bearing bolts.

7. The firearm of claim 5, the firearm comprising two stops and two stop bolts that have different distances from the sockets and the bearing bolts.

8. The firearm of claim 1, wherein a cross section of the groove is undercut, and the spring is a helical spring having an outer diameter that is larger than a narrow point of the undercut.

9. The firearm of claim 1, wherein the trigger device is housed in a trigger housing, and when an assembled state the trigger housing forms at least part of a rear wall of the duct.

10. The firearm of claim 1, wherein the duct is defined in a lower receiver of the firearm.

* * * * *